United States Patent [19]

Buan

[11] 4,401,031

[45] Aug. 30, 1983

[54] DISPOSABLE SELF CONTAINED INK CARTRIDGE FOR VALUE PRINTING DEVICE

[75] Inventor: Danilo P. Buan, Easton, Conn.

[73] Assignee: Pitney Bowes Inc., Stamford, Conn.

[21] Appl. No.: 334,933

[22] Filed: Dec. 28, 1981

[51] Int. Cl.[3] ..... B41F 1/46

[52] U.S. Cl. ..... 101/363

[58] Field of Search ..... 101/363, 367, 364, 335, 101/348, 350, 157

[56] References Cited

U.S. PATENT DOCUMENTS

| | | | |
|---|---|---|---|
| 2,007,588 | 7/1935 | Wescott | 101/367 X |
| 2,151,411 | 3/1939 | Shaw | 101/363 |
| 3,286,627 | 11/1966 | Cahn | 101/363 X |
| 3,457,858 | 7/1969 | Gibbs | 101/363 |
| 3,589,287 | 6/1971 | Woessner | 101/363 |
| 3,812,782 | 5/1974 | Funahashi | 101/367 |

FOREIGN PATENT DOCUMENTS

| | | | |
|---|---|---|---|
| 1290154 | 3/1969 | Fed. Rep. of Germany | 101/363 |
| 1933181 | 1/1970 | Fed. Rep. of Germany | 101/363 |

*Primary Examiner*—E. H. Eickholt

*Attorney, Agent, or Firm*—Peter Vrahotes; William D. Soltow, Jr.; Albert W. Scribner

[57] ABSTRACT

A novel ink cartridge for a value printing device such as a postage meter is disclosed having built-in handles so that the cartridge can be inserted and removed from a device without the need of a special tool and without risk of inking the operator's hands or clothing.

6 Claims, 7 Drawing Figures

Fig. 3.
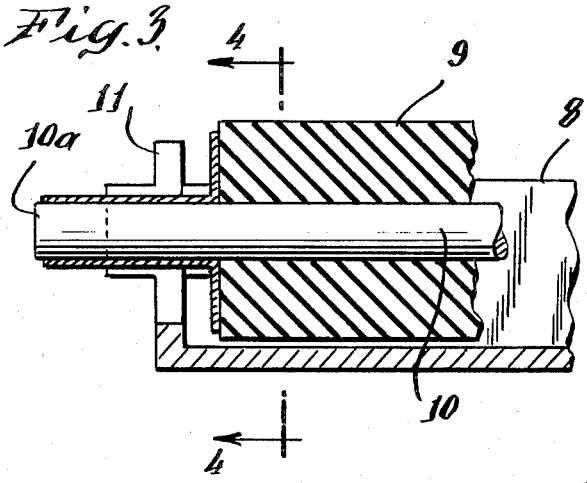
Fig. 4.
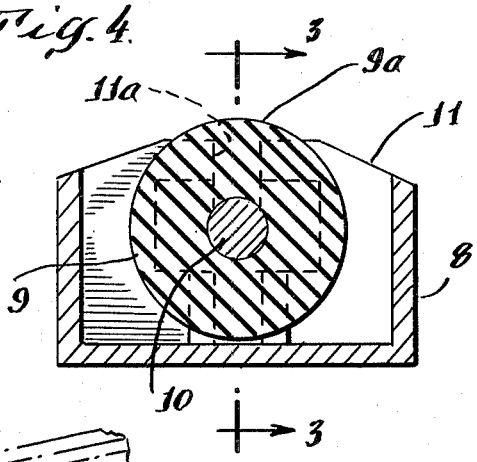
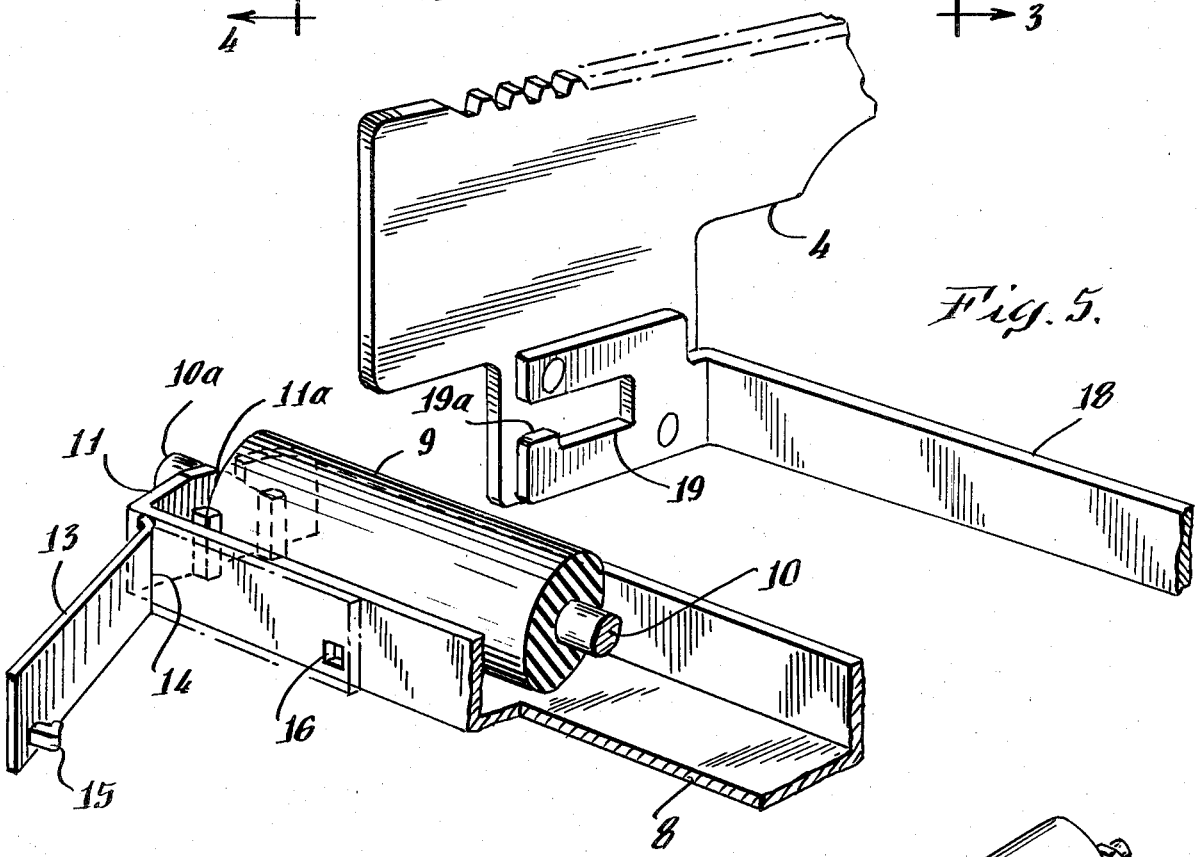
Fig. 5.
Fig. 6.
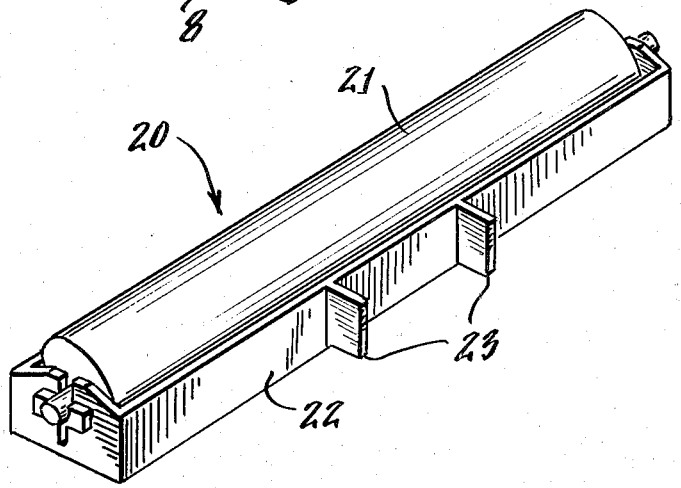

DISPOSABLE SELF CONTAINED INK CARTRIDGE FOR VALUE PRINTING DEVICE

BACKGROUND OF THE INVENTION

This invention relates to an improved value printing device such as an electric postage meter or register, which has incorporated into it a novel disposable, self-contained cartridge for inking the printing characters of the device, and to the improved inking cartridge itself.

Value printing devices such as labeling apparatus, postage meters and registers, and the like, print information onto a surface by contacting the surface with print characters which are inked typically just prior to the print event. In a postage meter, for example, relative movement occurs between the print characters and inking roller which contains its own supply of ink, which contacts and thus inks the characters. Generally the print characters are raised against the background of the printing head. While the various inventive aspects which follow will be described in connection with commercially available electric postage meters, it will be understood that they apply to any printing device with like characteristics.

In rotary-head postage meters and registers, such as Pitney Bowes' models 5300, 6300 and 6500 meters, the print characters are contained on a rotary printing head which revolves relative to a stationary inking roller during the print cycle.

When the raised print characters encounter the inking roller, they make contact and are thus inked. In so called flat-bed postage meters, such as a Pitney-Bowes' model 5700 series meters the print characters are contained on a horizontal, flat printing head. The mailpiece to be marked is moved rapidly up against the printing head with enough force to be marked. In the print cycle, the inking roller and its support carriage are moved across the print characters just before printing, the characters remaining stationary. After printing and mailpiece removal, the roller moves back across the printing head to its original rest position. The invention to be described can apply to both rotary and flat-bed postage meters and registers, but will be described specifically with regard to a flat-bed model 5700 series meter, a meter available commercially for many years.

Various aspects of this type of postage meter have been described in the U.S. Pat. Nos. 3,069,084; 3,244,096; 3,310,139; and 3,143,963. The latter patent relates to means for limiting the number of cycles of a postage meter in accordance of the capacity of the inking roller and thereafter rendering the ink roller unfit for use in the postage meter.

Currently, in the example of the Pitney Bowes' model 5700 series meter, an ink roller is replaced when, in the operator's judgment, the impressions produced by the meter grow faint or weak. A hand tool specially designed for the purpose is used to grip the ends of the ink roller and remove it from the movable carriage supporting it in the device. The hand tool is necessary to avoid manual removal of the ink roller, which would surely result in inking or staining of the operator's hands or clothing. Frequently however, the hand tool is misplaced or difficult to find. Without it the cartridge can only be removed manually with the above described inconvenience.

OBJECT OF THE INVENTION

It would therefore be of great advantage to an operator of such a device if the inking roller could be inserted and removed without the need of a special tool and without the need of the operator ever having to grip the inking roller with his hands. It is an object of this invention to solve this problem and to provide a novel disposable, self-contained inking cartridge for a value printing device, having handle members built into the cartridge for use in the insertion and removal of a cartridge from the printing device. This object is achieved by providing such a cartridge which comprises a housing having at least a portion of one side open, an inking roller capable of holding a supply of ink material, which is rotably mounted within the housing, and at least one handle member fixed to the housing.

DESCRIPTION OF THE DRAWINGS

FIG. 3 is a longitudinal cross-section of one end of the inventive cartridge.

FIG. 4 is a vertical cross-section of one end of the inventive cartridge.

FIG. 5 is a perspective view in broken-away form showing the orientation of a preferred embodiment of the inventive cartridge as it relates to the carriage bracket of the value printing device.

FIG. 6 is a front perspective view of another preferred embodiment of the inventive cartridge.

DESCRIPTION OF THE INVENTION

Figure 1:
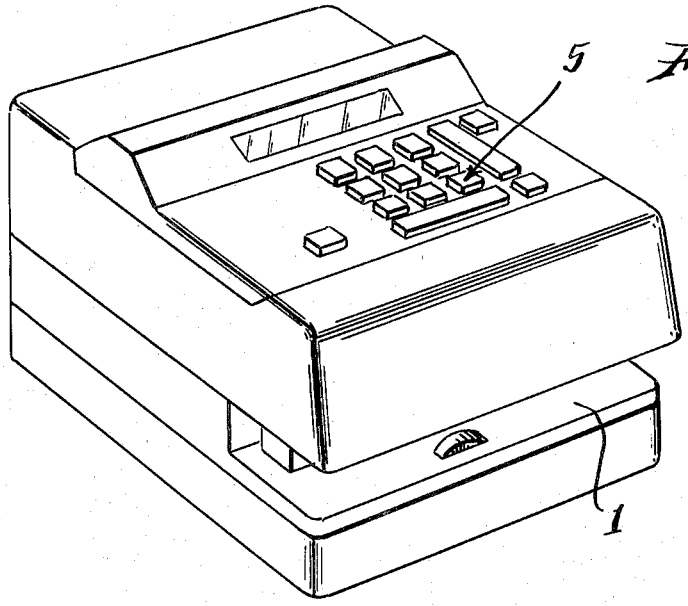
FIG. 1 is a front perspective view of a typical flat-bed electric postage meter.
Figure 7:
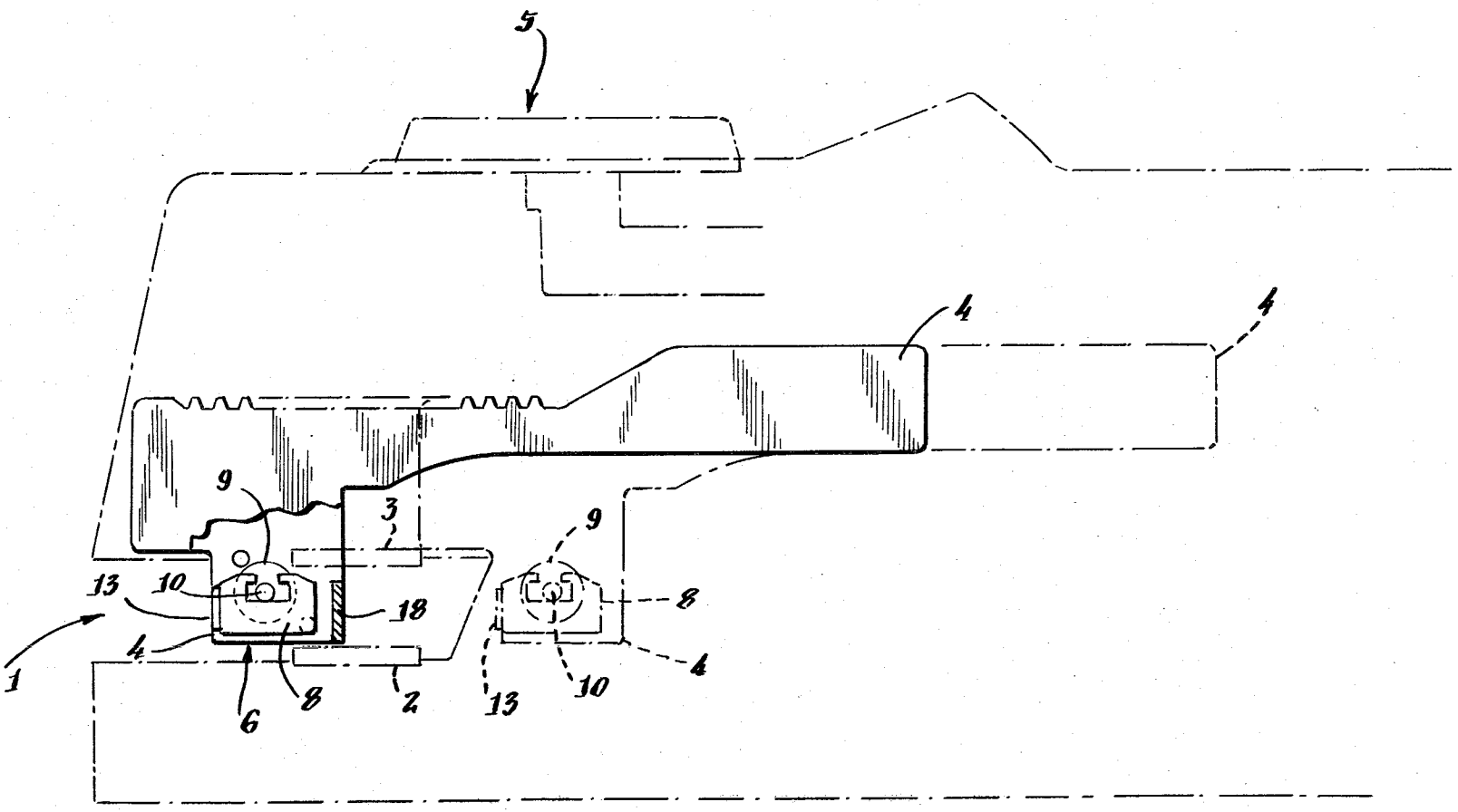
FIG. 7 is a partial side elevational view of the postage meter of FIG. 1 showing the placement and relative movement of the inking carriage.

Referring now to FIGS. 1 and 7 of the drawings, a typical commercially available flat-bed electric postage meter is illustrated, an example of which is a Pitney Bowes' model 5700 series meter. A printing station is provided comprising a recess 1, into which a mailpiece is inserted for postage impression, as is well known to the art. Various aspects of this type of postage meter are described more fully in U.S. Pat. No. 3,143,963, and in several of the other patents mentioned above. When a mailpiece is positioned in recess 1 properly so as to activate a switch, platen 2 is caused to move rapidly upward to force the mailpiece against a printing head 3 containing the raised print postage characters so as to be marked as desired. In the model 5700 series meter, the movement of the device, the setting of postage values and the memory units are all controlled mechanically and activated when the operator utilizes console keyboard 5.

The print characters contained on printing head 3 are inked just prior to printing, as illustrated in FIG. 7. A rotatably mounted ink roller 9 is supported in brackets of an inking carriage 4, which is mounted for left and right movement in the device, that is, from the front of the device toward the back of the device. As shown in FIG. 7, at the start of the printing cycle, the carriage is in its rest or home position 6, and when the mailpiece is inserted and the printing cycle begun, the carriage 4 is automatically reciprocated to the right to position 7. As the carriage thus moves, roller 9 is wiped across the print characters on printing head 3 and the characters are thus inked. When the carriage is in its retracted position 7, platen 2 moves the mailpiece upward against printing head 3 to place the postage values thereupon. After mailpiece removal, carriage 4 is automatically moved back to its home position 6. The drive means for automatically producing this movement is not shown here, but is adequately described in the patents above mentioned.

The ink rollers heretofore used in these devices are designed to be disposable when the ink supply which they contain has been exhausted to the point where the postage impressions become faint or illegible. The operator determines this by inspection of the quality of the postage impressions as time goes by. When the roller has reached the end of its useful life span, the operator then removes the spent roller by use of a special tool which is designed to grip each end of the roller shaft, thus enabling the operator to lift the roller from its seating in the carriage 4. As mentioned above, this tool must be kept handy, for if it is misplaced or otherwise not locatable, the operator must find some way of manually removing the roller with the risk of staining of the operator's hands and/or clothing. The present invention eliminates this particular problem.

The novel inking cartridge of this invention will now be described by referring to FIGS. 2–6. The inventive cartridge comprises a housing 8 having at least a portion of one wall open, an inking roller 9 adapted to be rotatably mounted within said housing 8, and handle members 13 are attached to the housing 8 which are to be used by the printing device operator to maneuver the cartridge into and out of the printing device.

Figure 2:
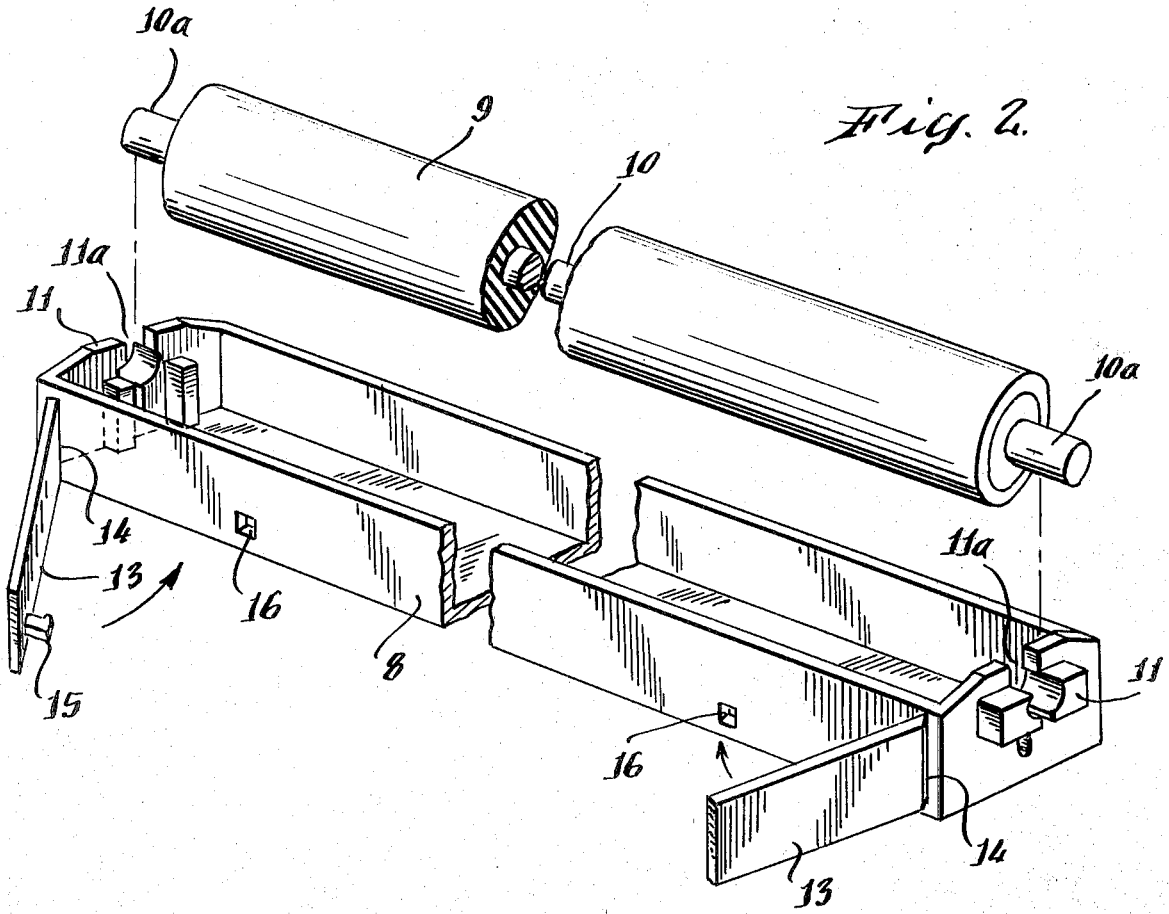
FIG. 2 is an exploded front perspective view of a preferred inking cartridge of this invention.

Referring to FIG. 2, the novel cartridge is illustrated in broken-away fashion, for a better understanding of its construction. The housing 8, in this particular embodiment, is effectively an elongated rectangular box opened at the top, and is split in the middle solely for illustrative purposes. Inking roller 9 is typically comprised of porous resilient material capable of holding a given supply of ink material, and surrounds a shaft 10 extending through the roller and emerging at the ends thereof. The end sides of housing 8 are slitted so as to receive shaft ends 10*a* of roller 9 therein, and are further fitted with lugs 11 which support the shaft ends 10*a* for a rotation of the roller. The housing 8 may be constructed of any suitable material, preferably a plastic. Although the roller 9 is mounted for rotation on a continuous shaft in this illustration, any suitable rotation means may be provided, such as individual pins mounted within the ends of the roller.

Still referring to FIG. 2, the novel cartridge is equipped with one or more handle members 13 so that the housing and inking roller can be maneuvered without directly contacting the roller. In the embodiment shown in FIG. 2, the handle members 13 are in the form of foldable flaps, which are either molded onto the housing or are attached thereto by a hinge member, but which are adapted for movement into and away from the housing at hinge area 14. Obviously, since the cartridge will be movable within the printing device, the handle members 13 must not interfere with such movement or the placing of postage impressions on a mailpiece. In the embodiment of FIG. 2, handle members 13 can be secured against housing 8 by means of lock tabs 15, which are designed to be inserted into openings 16 in the housing. The openings 16 are slightly smaller than the tabs 15 so that the handle members 13 will be secured when the tabs are inserted therein.

When the cartridge is to be maneuvered by the operator, the tabs 15 would be held in the open position as shown in FIG. 2 so as to be manually gripped. When the cartridge is being stored or is in place in the device, the handle members would be secured against the housing. The handle members 13 are shown in both open and closed configuration in FIG. 5.

Referring now to FIGS. 3 and 4, the rotational aspects of the novel cartridge are illustrated. FIG. 3 shows in vertical cross-section the roller 9 secured within housing 8, with shaft ends 10*a* resting in the U-shaped lugs 11. The roller 9 itself is of a width less than the width of the housing 8, as measured from the inside of the ends of the housing. When the shaft 10 of the roller 9 is resting in rotational configuration within housing 8, the bottom of the roller must obviously not touch the bottom of the housing, so as to be free to rotate, and the top surface of the roller must extend above the housing wall at least enough to ink the print characters without the housing coming into contact with the printing head. Within those parameters, any suitable geometrical configuration may be utilized without parting from the concept of this invention.

Referring to FIG. 4, an end side of housing 8 is illustrated in vertical cross-section, and also shows shaft end 10*a* resting for rotation in lugs 11. The slit 11*a* in housing 8 is desirably smaller in width than the diameter of shaft 10, such that, when shaft 10 is snap-fitted into ends of housing, although the roller will be free to rotate within lugs 11, upward movement of the roller within the housing will be resisted by the slightly smaller slit width. As can be seen, the top portion 92 of the roller 9 extends above the housing 8 in order to be able to contact the print characters when in use.

As indicated previously, and as illustrated in the patents above mentioned, the prior art ink rollers are mounted for rotation in a movable carriage which reciprocates back and forth within the printing device in order to ink the characters. The same basic concept is employed herein except that the carriage brackets are adapted to mount the ink cartridge of this invention, instead of the ink roller directly. Referring to FIG. 5, one-half of the inking carriage 4 is shown to which is mounted a tie bar 18 by means of end brackets 19. Brackets 19 are shaped to receive the lugs 11 of the novel cartridge of this invention, and have a ridge 19*a* which, when the cartridge is inserted in the carriage, resists back and forth movement of the cartridge within the carriage brackets 19. Thus, again referring to FIG. 5, the inking cartridge is moved into the carriage by sliding lugs 11 into the openings of brackets 19 and allowing the lugs to sit within the bracket opening with the front edge of the lug in abutting relationship with ridge 19*a*. The details of the movement of a carriage into and out of the printing device are described in U.S. Pat. No. 3,143,963, referred to above.

Referring to FIG. 6, a second preferred embodiment of a novel cartridge of this invention is illustrated. Cartridge 20 is comprised of an inking roller 21 rotatably mounted within a partially open housing 22. In this particular embodiment, handle members 23 are unitarily molded or constructed into the housing and are not movable. They extend far enough from the housing that they may be gripped by the operator when it is desired to move the cartridge. The handles do not extend so far from the housing however that they would interfere with the upward movement of the mailpiece in the printing device.

The exact construction of the handle members of the novel cartridge described herein is not deemed to be critical to this invention. Although we have described two types of handle construction herein, other variances will suggest themselves to those skilled in the art without departing from the scope of this invention.

What is claimed is:

1. A disposable cartridge for inking the print characters of a value printing device, the value printing device being of the type having a movable inking carriage with longitudinally opposed openings, which comprises:

(a) a housing having an extending opening;

(b) inking means rotatably mounted within said housing and extending through said opening;

(c) at least one handle member fixed to said housing; and (d) a pair of lugs each of which is located at an opposite end of said housing, the lugs being receivable within said carriage openings to support said housing; whereby said housing may be inserted and removed into and out of said inking carriage by use of said handle member.

2. The cartridge of claim 1 wherein said inking means is a roller comprised of a porous resilient substance and containing a supply of inking material within said porous substance.

3. The cartridge of claim 2 in which said housing is an elongated rectangular box having at least a portion of one side open.

4. The cartridge of claim 3 in which said at least one handle member comprises a flap rotatably fixed to said housing.

5. The cartridge of claim 3 wherein said at least one handle member is a grippable element unitarily constructed with said housing.

6. The cartridge of claim 4 in which said flap is adapted to be secured against a surface of said housing.

* * * * *